US007491295B2

(12) United States Patent
Poikolainen et al.

(10) Patent No.: US 7,491,295 B2
(45) Date of Patent: Feb. 17, 2009

(54) DEWATERING ELEMENT HAVING NON-PULSING DEWATERING FOLLOWED BY PULSING DEWATERING

(75) Inventors: Antti Poikolainen, Jyväskylä (FI); Marko J. Moilanen, Vesanka (FI); Kari Lamminmäki, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 429 days.

(21) Appl. No.: 11/416,400

(22) Filed: May 2, 2006

(65) Prior Publication Data

US 2007/0235153 A1 Oct. 11, 2007

(30) Foreign Application Priority Data

Apr. 7, 2006 (FI) ..... 20060155 U

(51) Int. Cl.
*D21F 11/04* (2006.01)

(52) U.S. Cl. ..... 162/203; 162/352; 162/374; 162/211; 162/300

(58) Field of Classification Search ..... 162/352, 162/351, 301, 300, 203, 211, 374
See application file for complete search history.

(56) References Cited

U.S. PATENT DOCUMENTS 1,917,098 A 7/1933 Cofrin
6,372,091 B2 4/2002 Wildfong et al.
7,364,643 B2 * 4/2008 Poikolainen et al. ..... 162/203
2004/0188050 A1 9/2004 Henssler
2008/0115902 A1 * 5/2008 Poikolainen et al. ..... 162/301

FOREIGN PATENT DOCUMENTS

WO WO 2004/018768 A1 3/2004

* cited by examiner

*Primary Examiner*—Mark Halpern
(74) *Attorney, Agent, or Firm*—Stiennon & Stiennon

(57) ABSTRACT

A forming section of a paper or board machine 10 in the forming section of a paper or board machine has a cover 36 having an outlet groove 20 between a suction zone 18 of circular holes and an outlet edge 40. A wire comes to the cover area from an inlet edge 38 and leaves from an outlet edge 40. The outlet groove 20 is essentially in the cross-machine direction of the cover 36. The suction zone accomplishes non-pulsating dewatering, and the outlet groove accomplishes pulsating dewatering. The non-pulsating suction zone first accomplishes good retention, and after this formation is improved on the outlet groove. When pulsating dewatering takes place in the same direction as non-pulsating dewatering and immediately after non-pulsating dewatering, the web formed has a particularly good formation potential. Potential marking caused by non-pulsating dewatering can also be removed efficiently by means of pulsating dewatering taking place on the same side.

18 Claims, 2 Drawing Sheets

DEWATERING ELEMENT HAVING NON-PULSING DEWATERING FOLLOWED BY PULSING DEWATERING

CROSS REFERENCES TO RELATED APPLICATIONS

This application claims priority on Finnish Application No. U20060155, Filed Apr. 7, 2006, the disclosure of which is incorporated by reference herein.

STATEMENT AS TO RIGHTS TO INVENTIONS MADE UNDER FEDERALLY SPONSORED RESEARCH AND DEVELOPEMENT

Not applicable.

BACKGROUND OF THE INVENTION

The present invention concerns a dewatering element on the forming section of a paper or board machine, where the forming section comprises a movable wire, which is in contact with the wall of the dewatering element, with the wall having a non-pulsating suction zone which is at least as wide as the wire. The present invention also concerns a cover of a dewatering element of a paper or board machine.

Pulsating and non-pulsating dewatering elements have been used on paper and board machines. Non-pulsating dewatering elements provide good retention. Pulsating dewatering elements, in turn, give good formation. Non-pulsating dewatering is often arranged by means of a roll unit followed by a pulsating foil unit. This arrangement first provides good retention and then improved formation. The use of a roll gap former imposes restrictions on the speed applied. Blade gap formers, which feature pulsating dewatering right at the beginning, have hence been introduced in order to enable increased speed. However, retention has been very low with these, and the paper is anisotropic in the z direction. Problems encountered in the above-mentioned technologies have been solved for example through means described in patent publication WO2004/018768. In the technology presented in this publication, non-pulsating dewatering elements have been implemented by means of a non-pulsating suction zone included in the dewatering element. It is well known that retention is better with this type of non-pulsating dewatering than with pulsating dewatering, but formation is poorer. Furthermore, the dimensions of the paper or board machine grow as the machine speed increases.

SUMMARY OF THE INVENTION

The object of the present invention is to accomplish a dewatering element on the forming section of a paper or board machine which offers a more optimum relationship between retention and formation than before.

Another object of the invention is to accomplish a cover of a dewatering element of a paper or board machine. According to the invention, the dewatering element and its cover comprise an outlet groove after the suction zone. The dewatering element according to the invention accomplishes non-pulsating and pulsating dewatering in a single dewatering element. Immediately after non-pulsating dewatering, there is pulsating dewatering on the same side of the web. When non-pulsating and pulsating dewatering are performed in a single dewatering element, the size of the unit can be decreased. As is well known, this is a main objective in the engineering of paper machines, because otherwise the dimensions of machines would grow as machine speeds increase.

The dewatering element according to the invention can be used on the forming section of a paper or board machine. The forming section includes a wire, which revolves as an endless loop. The wire is in contact with the wall of the dewatering element, with the wall having a non-pulsating suction zone which is at least as wide as the wire. In the travel direction of the wire, there is an outlet groove on the said wall after the suction zone essentially in the cross-machine direction of the paper or board machine. The suction zone and the outlet groove are hence on the wall which is touched by the wire. In other words, as the wire moves, water is sucked from the fibrous stock located on its other side first on the suction zone, and after this suction continues on the outlet groove. The suction zone accomplishes non-pulsating dewatering, and the outlet groove accomplishes pulsating dewatering. The suction zone hence first provides good retention, and the outlet groove improves formation after this. When pulsating dewatering takes place in the same direction as non-pulsating dewatering and immediately after non-pulsating dewatering, the web formed has a particularly good formation potential. The slight marking caused by non-pulsating dewatering is removed efficiently as pulsating dewatering takes place immediately after non-pulsating dewatering in the same direction as non-pulsating dewatering.

In one embodiment, there is an inlet groove on the said wall before the suction zone in the travel direction of the wire essentially in the cross-machine direction of the paper or board machine. The inlet groove, suction zone and outlet groove are hence on the wall which is touched by the wire. The inlet groove removes air which is mixed with the flow of the headbox. The inlet groove also removes efficiently air which has entered the wire gap and which is not yet mixed with the fibrous stock but is in a separate phase. When the inlet groove removes a considerable portion of the air which has entered the wire gap and of the air which is partly mixed with the headbox flow, more water can be removed from the spread fibrous stock on the suction zone than on a suction zone which is not preceded by an inlet groove. Dewatering on the outlet groove following the suction zone is carried out as pulsating dewatering, which improves formation. In some paper grades, it has been noticed that the drill pattern of the holes of the non-pulsating dewatering zone can be seen faintly on the surface of the web formed, which constitutes a problem. This problem can be eliminated by the outlet groove, which balances the moisture profile of the web. When air is removed from the spread fibrous stock on the inlet groove, a shorter suction zone can be used while the machine speed still remains the same.

In another embodiment, the outlet groove, inlet groove or both are composed of a uniform slot which extends through the wall. The length of the slot is such that the slot extends essentially over the width of the wire and the web formed. When the groove is a slot which extends through the wall, it is easy to make the groove. When the slot which forms the groove is essentially as wide as the wire, pulsating dewatering can be carried out over the entire width of the spread fibrous stock simultaneously. This type of simultaneous pulsating dewatering creates a good formation potential for the web formed by the fibrous stock. The said wall of the dewatering element, containing the suction zone and outlet groove, can be manufactured from many materials, but it is preferably manufactured from a ceramic material.

In the following the invention is described in more detail with reference to the accompanying drawings describing some applications of the invention.

DESCRIPTION OF THE PREFERRED EMBODIMENTS

Figure 1:
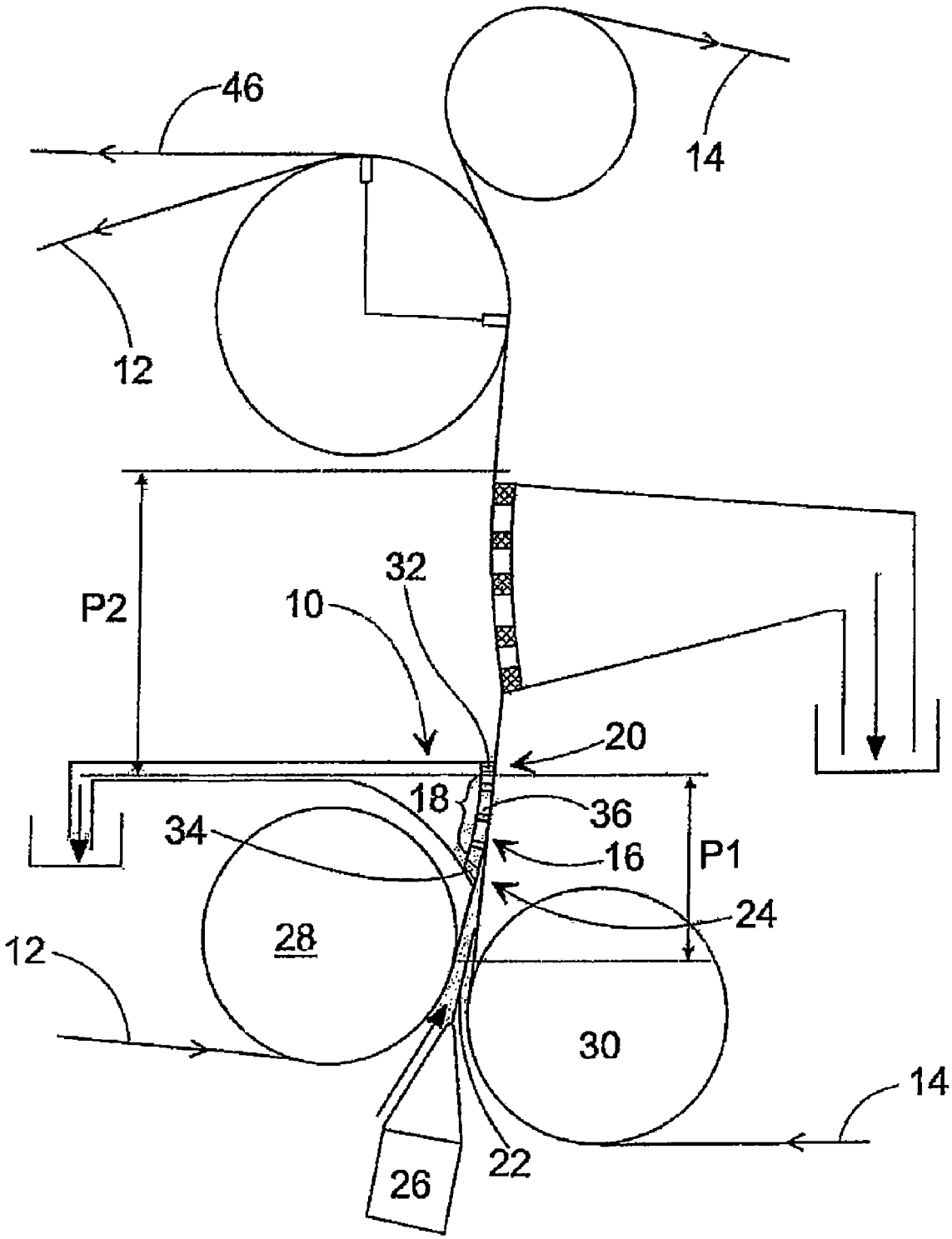
FIG. 1 presents a dewatering element according to the invention on the forming section of a paper or board machine.

FIG. 1 presents a dewatering element 10 according to the invention on the forming section of a paper or board machine. The forming section comprises two wires 12 and 14, which revolve as endless loops. The wire 12 is in contact with the wall 16 forming the outer surface of a cover 36 of the dewatering element 10, with the wall 16 having a non-pulsating suction zone 18 which is at least as wide as the wire 12. According to the invention, there is a novel outlet groove 20 on the wall 16 after the suction zone 18 in the travel direction of the wire 12. The suction zone 18 and outlet groove 20 are hence on the wall which is touched by the wire 12. The suction zone is preferably perforated. The dewatering element 10 sucks water from the fibrous stock 22 through the wire 12 first on the suction zone 18 and thereafter on the outlet groove 20. Non-pulsating dewatering is accomplished on the suction zone. Pulsating dewatering is accomplished on the outlet groove. Non-pulsating dewatering takes place on the forming section over distance P1. Pulsating dewatering takes place over distance P2. The non-pulsating suction zone first accomplishes efficient dewatering and good retention, and after this formation is improved on the outlet groove. When pulsating dewatering takes place in the same direction as non-pulsating dewatering and immediately after non-pulsating dewatering, the web formed obtains a particularly good formation potential, and marking caused by non-pulsating dewatering can be removed from the web. The case illustrated in FIG. 1 is only one potential application for the dewatering element according to the invention, and it can also be used with many other types of forming sections.

In the dewatering element 10 illustrated in FIG. 1, there is also an inlet groove 24 on the wall 16 before the suction zone 18 in the travel direction of the wire 12. The inlet groove 24 is essentially in the cross-machine of the paper or board machine, as is the outlet groove. The inlet groove 24, suction zone 18, and outlet groove 20 are located on the same wall 16. Fibrous stock 22 is spread on the other side of the wire 12 as seen from the wall 16, and the wire 12 touches the wall 16 as it passes the wall 16. The arrow beside the headbox 26 in FIG. 1 describes the travel direction of the wire and fibrous stock. Guide rolls 28 and 30 guide the wires 12 and 14. Fibrous stock 22 is directed from the headbox 26 past the guide rolls 28 and 30 between the wires 12 and 14. After dewatering, the fibrous stock 22 has turned into a web 46. Dewatering from the fibrous stock becomes more efficient using a dewatering element according to the invention. Air goes between the wires with fibrous stock. This air can be removed efficiently by the inlet groove. The inlet groove removes efficiently air which is not yet mixed with the fibrous stock but is still in a separate layer. When the inlet groove removes a considerable portion of the air which travels with the fibrous stock which has been spread on the wire, more water can be removed from the spread fibrous stock on the suction zone after the inlet groove than on a suction zone which is not preceded by an inlet groove. Dewatering on the outlet groove following the suction zone is carried out as pulsating dewatering, which improves formation. Air removal from the spread fibrous stock on the inlet groove enables the use of a shorter suction zone or a lower vacuum in the suction zone. Machine speed can also be raised as dewatering becomes more efficient.

In the dewatering element 10 illustrated in FIG. 1, both the inlet groove 24 and outlet groove 20 go through the cover 36, so that the inlet groove and outlet groove are composed of slots. The necessary pulsation can be accomplished for example on the outlet groove, which is provided with vacuum by means of channels (not illustrated). The outlet groove 20 is preferably an outlet slot 32, which extends through the wall 16. Dewatering hence takes place evenly over the entire width of the outlet slot. It is also easier to manufacture an outlet slot than for example complicated channels. Correspondingly, the inlet groove 24 is preferably an inlet slot 34. The inlet slot correspondingly enables even dewatering in the cross-machine direction of the wire. The said wall of the dewatering element, containing the inlet groove, suction zone and outlet groove, can be manufactured from many materials, but the wall is preferably manufactured from a ceramic material.

Figure 2:
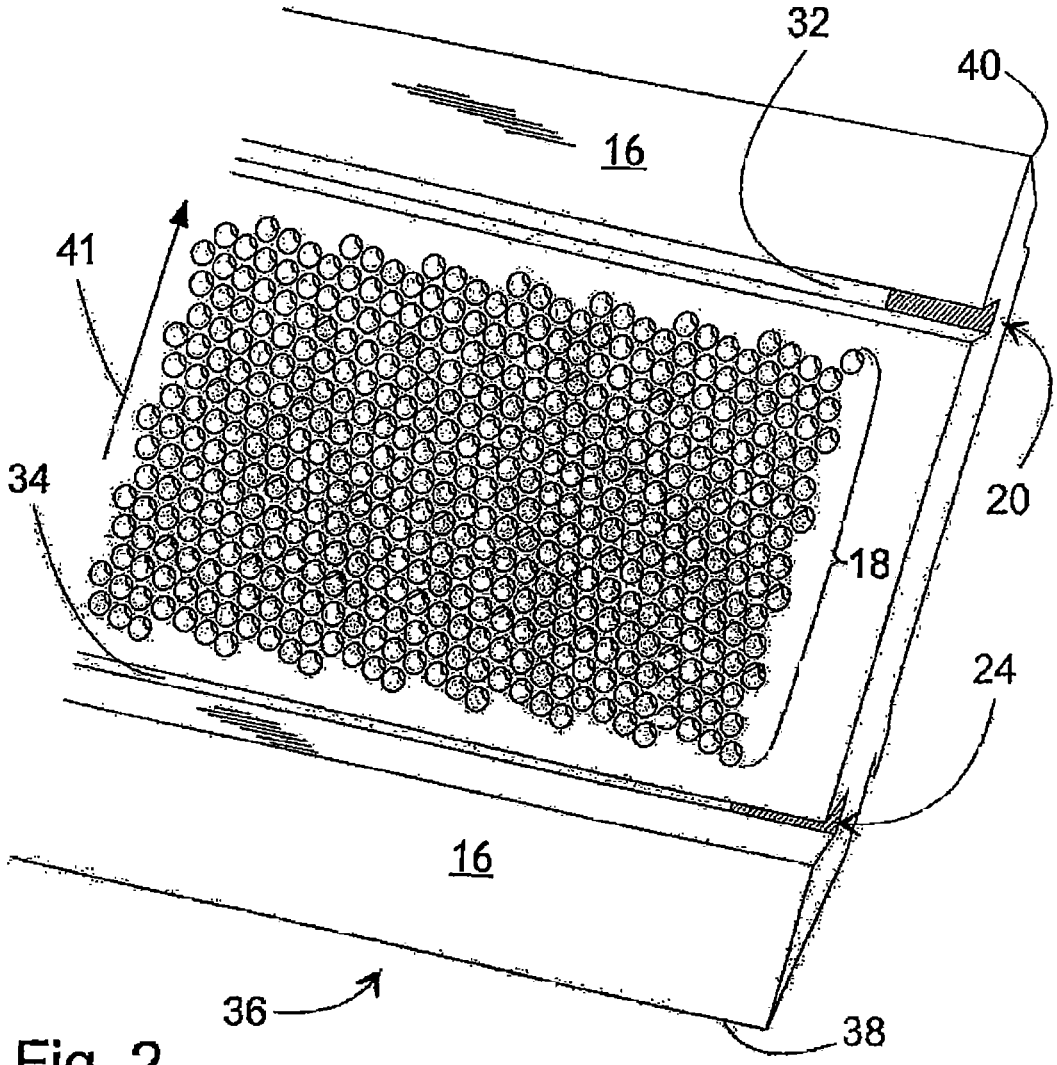
FIG. 2 presents a cover of a dewatering element according to the invention seen diagonally from the side.

FIG. 2 illustrates the cover 36 of the dewatering element according to the invention, with the cover 36 containing an inlet edge 38 and an outlet edge 40. The cover 36 also contains a suction zone 18. According to the invention, the cover 36 contains an outlet groove 20 between the suction zone 18 and outlet edge 40. In FIG. 2, the wire travels in the direction shown by arrow 41. The wire is in contact with the wall 16 of the cover 36, and the wire comes to the cover area from the front or inlet edge 38 and leaves the cover area from the back or outlet edge 40. The outlet groove 20 is essentially in the cross-machine direction of the cover 36. The direction of the outlet groove can vary 0-5°, preferably 0-3° from the cross-machine direction of the paper or board machine. Seen from the surface of the cover, the shape of the grooves can also be other than straight, i.e. the groove can be winding (not illustrated). If the groove is winding e.g., zigzag, the direction of the outlet groove can vary more. There can also be several grooves (not illustrated). The essential feature is that the suction zone accomplishes non-pulsating dewatering, and the outlet groove accomplishes pulsating dewatering. The non-pulsating suction zone first accomplishes good retention, and after this formation is improved on the outlet groove. When pulsating dewatering takes place in the same direction as non-pulsating dewatering and immediately after non-pulsating dewatering, the web formed has a particularly good formation potential. Potential marking caused by non-pulsating dewatering can also be removed efficiently by means of pulsating dewatering taking place on the same side. FIG. 2 illustrates circular holes, as seen from the surface, which are one way of carrying out non-pulsating dewatering. Non-pulsating dewatering can also be carried out by means of grooves which are almost in the machine direction. When the grooves are almost in the machine direction, they do not cause a sudden pressure change, but the grooves exert the vacuum gradually at different points in the cross-machine direction of the paper or board machine. Dewatering taking place at the grooves is hence non-pulsating. However, essentially circular holes are preferably used in exerting the vacuum on the fibrous stock located on the other side of the wire.

In the cover 36 illustrated in FIG. 2, there is an inlet groove 24 between the inlet edge 38 and the suction zone 18. The inlet groove 24 is essentially in the cross-machinedirection of the paper or board machine. Air goes between the wires with fibrous stock. This air can be removed efficiently by the inlet groove. When the inlet groove removes a considerable portion of the air which travels with the fibrous stock which has been spread on the wire, more water can be removed from the fibrous stock on the suction zone than using a cover 36 which does not have an inlet groove. Both the inlet groove 24 and outlet groove 20 go through the cover 36. In this case, the inlet groove 24 is made up of an inlet slot 34, and the outlet groove 20 is made up of an outlet slot 32. The inlet slot 34 and the outlet slot 32 can be machined easily. Both the inlet slot 34 and the outlet slot 32 are essentially in the cross-machinedirection of the cover 36. Both the inlet slot 34 and the outlet slot 32 are essentially of a similar length as the width of the wire and suction zone. The longitudinal direction of the inlet slot 34 and the outlet slot 32 is in cross direction to the paper or board machine. There are grooves extending from the inlet slot 34 and the outlet slot 32 so that the inlet groove 24 and the outlet groove 20 can cover the entire width of the cover 36. The width of the outlet groove in the longitudinal direction i.e. machine direction of the paper or board machine is 5-40 mm, preferably 10-20 mm. The length of the cover in the machine direction of the paper or board machine is 200-700 mm, preferably 350-500 mm.

Figure 3:
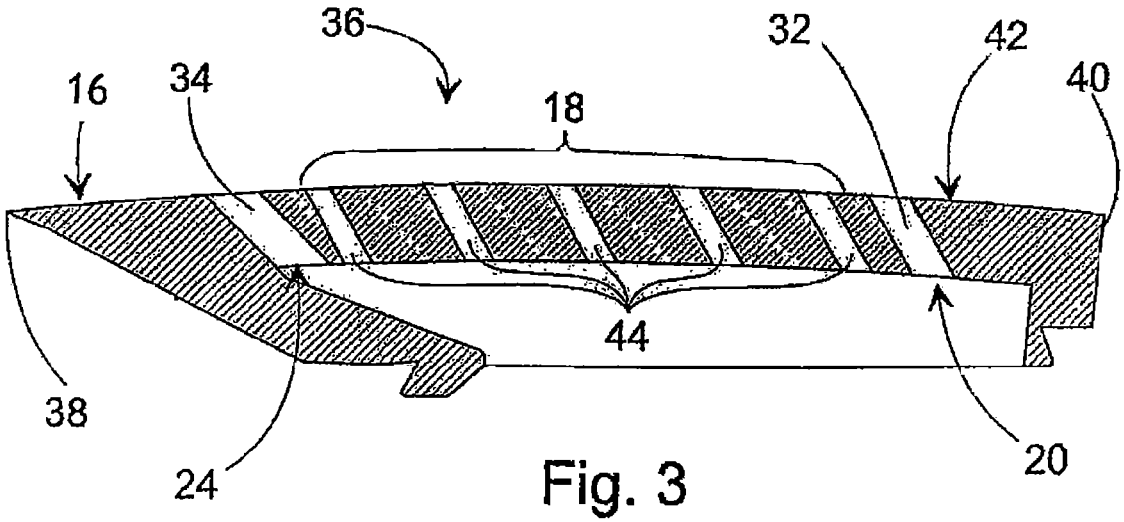
FIG. 3 presents a cross-section of a cover of a dewatering element according to the invention.

FIG. 3 presents a cross section of a cover 36 of a dewatering element according to the invention. The wire touches the outer surface 42 of the cover 36, with the outer surface 42 being curved. A curved cover makes the gap between the wires close. The radius of curvature of the outer surface is 300-8000 mm, preferably 900-2000 mm. There is a suction zone 18 in the middle of the cover. There is an inlet slot 34 between the inlet edge 38 and the suction zone 18, and there is an outlet slot 32 between the suction zone 18 and the outlet edge 40. Both the inlet slot 34 and the outlet slot 32 are aslant when seen from the cover end. The circular holes 44 which preferably make up the suction zone 18 are also aslant with respect to the travel direction of the wire.

Non-pulsating dewatering refers to dewatering from the web when no pressure pulses caused by the shape of the dewatering element are exerted on the web. Such non-pulsating shapes are round and oval holes as well as grooves which run essentially in the travel direction of the web. In the region of non-pulsating dewatering, water is removed from the web by means of vacuum, wire tension and curved cover.

In the region of pulsating dewatering, pressure pulses caused by the shape of the dewatering element are exerted on the web. Such shapes include dewatering foils in the cross direction of the machine.

It should be understood that has used in the claims, immediately following, means the next dewatering element in the downstream direction.

It is understood that the invention is not limited to the particular construction and arrangement of parts herein illustrated and described, but embraces all such modified forms thereof as come within the scope of the following claims.

We claim:

1. A dewatering element in a forming section of a paper or board machine, comprising:

a dewatering element in the forming section having a wall, wherein an endless wire is in contact with the wall and mounted for motion over the wall in a downstream machine direction, the wire having a cross machine direction width;

wherein the wall has portions which define a non-pulsating suction zone which extends in the machine direction, wherein the non-pulsating suction zone also extends in the cross machine direction a width which is at least as wide as the width of the wire; and portions of the wall forming an outlet groove located after the non-pulsating suction zone in the downstream machine direction, the outlet groove extending essentially in the cross machine direction.

2. The dewatering element of claim 1, wherein the wall has portions forming an inlet groove upstream in the machine direction of the non-pulsating suction zone, the inlet groove extending essentially in the cross machine direction.

3. The dewatering element of claim 2, wherein the inlet groove comprises a uniform slot which extends through the wall, and extends essentially over the width of the wire.

4. The dewatering element of claim 3 wherein the outlet groove comprises a uniform slot, which extends through the wall, and extends essentially over the width of the wire.

5. The dewatering element of claim 1, wherein the outlet groove comprises a uniform slot, which extends through the wall, and extends essentially over the width of the wire.

6. The dewatering element of claim 1, wherein the wall is formed of a ceramic material.

7. A cover of a dewatering element in a paper or board machine in a forming section of a paper or board machine having an endless wire defining a width, said wire in contact with a cover, the cover comprising:

portions defining an inlet edge and an outlet edge over which the wire is arranged to travel;

portions of the cover defining a non-pulsating suction zone positioned between the inlet edge and the outlet edge, the non-pulsating suction zone being at least as wide as the wire; and portions forming an outlet groove essentially in the cross-machine direction of the paper or board machine between the suction zone and the outlet edge.

8. The cover of claim 7, further comprising portions of the cover forming an inlet groove essentially in the cross-machine direction of the paper or board machine between the inlet edge and the suction zone.

9. A forming section of a paper or board machine, comprising:

a first guide roll;

a first endless wire loop extending around the first guide roll;

a second guide roll;

a second endless wire loop extending around the second guide roll;

a headbox positioned with respect to the first guide roll and the second guide roll to form a gap former, such that fibrous stock discharged from the headbox is directed downstream from the headbox past the first and second guide rolls and between the first and second endless wire loops;

a first dewatering element in the forming section engaged with the first forming wire and having a wall, wherein the wall has a non-pulsating suction zone which extends in the machine direction, and the non-pulsating suction zone also extends in the cross machine direction a width at least as wide as the width of the wire, and wherein after the non-pulsating suction zone in the downstream machine direction, portions of the wall form an outlet groove which is a pulsating dewatering feature, which extends essentially in the cross machine direction; and a pulsating type dewatering element in the forming section engaged with the second forming wire, immediately following the first dewatering element.

10. The dewatering element of claim 9, wherein the first dewatering element wall has portions forming an inlet groove upstream in the machine direction of the suction zone, the inlet groove extending essentially in the cross machine direction.

11. The forming section of a paper or board machine of claim 10, wherein the first dewatering element inlet groove comprises a uniform slot which extends through the wall, and extends essentially over the width of the wire.

12. The forming section of a paper or board machine of claim 11 wherein the first dewatering element outlet groove comprises a uniform slot, which extends through the wall, and extends essentially over the width of the wire.

13. The forming section of a paper or board machine of claim 9, wherein the first dewatering element outlet groove comprises portions defining a uniform slot, which extends through the wall, and extends essentially over the width of the wire.

14. The forming section of a paper or board machine of claim 9, wherein the first dewatering element wall is formed of a ceramic material.

15. A method of forming a web in a twin-wire formation section of a paper or board machine, comprising the steps of:

supplying a lip jet of fibrous stock from a headbox to a first forming wire forming a first wire loop so that the fibrous stock travels only on the first forming wire;

moving a second forming wire forming a second wire loop against a fixed dewatering element, the fixed dewatering element having a leading edge and a wall having a curved cover, the second forming wire being supported by and moving against a curved surface defined by the curved cover of the fixed dewatering element;

bringing the fibrous stock on the first forming wire into engagement with the second forming wire on the curved surface of the fixed dewatering element cover at a position after the fixed dewatering element leading edge, the first forming wire being unsupported in an area defined by the curved cover of the fixed dewatering element;

guiding the fibrous stock between the first and second forming wires over a first non-pulsating suction zone so that dewatering of the fibrous stock begins after the fixed dewatering element leading edge, wherein essentially non-pulsating dewatering takes place in a first non-pulsating suction zone; and removing water from the fibrous stock after non-pulsating dewatering takes place in the first non-pulsating suction zone by pulsating dewatering the fibrous stock over an outlet groove which extends essentially in the cross machine direction, the outlet groove formed of portions of the wall of the fixed dewatering element.

16. The method of claim 15 further comprising removing air from between the fibrous stock and the second forming wire through an inlet groove before dewatering the fibrous stock in the first non-pulsating suction zone.

17. A dewatering element in a forming section of a paper or board machine, comprising:

the dewatering element having a curved outer surface between an inlet edge and an outlet edge, wherein an endless wire is in contact with the outer surface and mounted for motion over the curved outer surface in a downstream machine direction, the wire having a cross machine direction width;

wherein the curved outer surface has portions which define a non-pulsating suction zone formed of an array of holes which extend through the dewatering element, the array of holes extending in the machine direction, and the array of holes extending in a cross machine direction a width which is at least as wide as the width of the wire; and portions of the dewatering element forming an outlet groove located after the non-pulsating suction zone in the downstream machine direction, the outlet groove extending essentially in the cross machine direction a width which is at least as wide as the width of the wire, and the outlet groove extending through the dewatering element.

18. The dewatering element of claim 17, wherein the dewatering element has portions forming an inlet groove upstream in the machine direction of the non-pulsating suction zone, the inlet groove extending essentially in the cross machine direction a width which is at least as wide as the width of the wire, and the inlet groove extending through the dewatering element.

* * * * *